US008608520B2

(12) United States Patent
Yuan

(10) Patent No.: US 8,608,520 B2
(45) Date of Patent: Dec. 17, 2013

(54) CABLE CONNECTOR HAVING A CIRCUIT BOARD PARTIALLY ENCASED BY A COATING AND CONNECTED TO A CABLE

(75) Inventor: Wei Yuan, Dongguan (CN)

(73) Assignee: Molex Incorporated, Lisle, IL (US)

( * ) Notice: Subject to any disclaimer, the term of this patent is extended or adjusted under 35 U.S.C. 154(b) by 22 days.

(21) Appl. No.: 13/486,174

(22) Filed: Jun. 1, 2012

(65) Prior Publication Data

US 2012/0309235 A1 Dec. 6, 2012

(30) Foreign Application Priority Data

Jun. 1, 2011 (CN) ..... 2011 2 0197184 U
Jul. 7, 2011 (TW) ..... 100212433 U

(51) Int. Cl.
*H01R 9/24* (2006.01)

(52) U.S. Cl.
USPC ..... 439/886

(58) Field of Classification Search
USPC ..... 439/886–889, 660
See application file for complete search history.

(56) References Cited

U.S. PATENT DOCUMENTS

| | | | | |
|---|---|---|---|---|
| 6,203,387 | B1 * | 3/2001 | Daly et al. | 439/886 |
| 7,273,401 | B2 * | 9/2007 | Zaderej et al. | 439/886 |
| 7,699,672 | B2 * | 4/2010 | Zaderej et al. | 439/886 |
| 8,092,263 | B2 * | 1/2012 | Moriuchi et al. | 439/886 |
| 2008/0003867 | A1 * | 1/2008 | Wu | 439/490 |

* cited by examiner

*Primary Examiner* — Chandrika Prasad
(74) *Attorney, Agent, or Firm* — Timothy M. Morella

(57) ABSTRACT

A cable connector comprises a first connector and a cable. The first connector comprises a first connector body and a first circuit board. The first circuit board has first and second surfaces, a plurality of first connection points installed on the first surface, and soldering portions of the first conductive terminals correspondingly soldered to the first connection points. The first circuit board has a plurality of second connection points on the first and second surfaces, and the cable's conducting wires are correspondingly soldered to each second connection point. The first connector comprises a first coating partially encasing the first circuit board. The first coating comprises first and second portions. The first portion encases one side of the first surface in order to encase the first connection points. The second portion encases the edge of the first and second surfaces in order to encase the second connection points.

20 Claims, 6 Drawing Sheets

CABLE CONNECTOR HAVING A CIRCUIT BOARD PARTIALLY ENCASED BY A COATING AND CONNECTED TO A CABLE

REFERENCE TO RELATED APPLICATIONS

The Present Disclosure claims priority to prior-filed Chinese Utility Model Patent Application No. 201120197184.7, entitled "Cable Connector," filed on 1 Jun. 2011 with the State Intellectual Property Office of the People's Republic of China; and to Taiwanese Utility Model Patent Application No. 100212433, entitled "Cable Connector," filed on 7 Jul. 2011 with the Patent Office of the Republic of China. The content of each of the aforementioned Patent Applications is incorporated in their entireties herein.

BACKGROUND OF THE PRESENT DISCLOSURE

The Present Disclosure relates generally to a cable connector, and in particular, to a cable connector having a reliable connection between the conductive terminals and circuit board.

Chinese Patent No. ZL200810302574.9 reveals a cable connector assembly comprising an insulator body, a number of terminals contained within the insulator body, a number of conducting wires electrically connected to the terminals, and a shell overmolded to the insulator body. The insulator body is elongated, and comprises a base portion and a matching portion extending forward from the base portion. The terminals comprise a set of signal terminals and a set of power terminals. The conducting wires comprise a set of signal wires and a set of power wires. The matching portion comprises a first mating area and second mating area corresponding to the two sets of terminals. The tail portions of the signal terminals and the tail portions of the power terminals are soldered to a circuit board, and the circuit board has corresponding solder holes. These signal terminal tail portions are inserted into the solder holes and soldered to the circuit board. The power wires and signal wires are also soldered to the circuit board and exit in a direction perpendicular to the mating direction.

The power wires and signal wires of this type of existing cable connector structure are soldered to the one-sided solder points of the circuit board. The relatively dense arrangement of solder points is not suited to solder wire. In addition, the shell completely encases the circuit board. Because the terminals are soldered to the circuit board by being inserted into solder holes, when conducting overmolding for this shell, the injected melted plastic material can have a jacking effect, pulling the tail portions of the terminals away from the back of the circuit board. Thus, it could impair the connection between the terminals and circuit board and lead to poor products. Also, this cable connector does not have an external shielding structure. When employed in high speed, high frequency data transmissions, this connector has a difficult time meeting electromagnetic compatibility (EMC) requirements. In addition, this type of insulator body involves attaching two backward extending locking arms to the two sides of the circuit board. These locking arms, formed as a part of the insulator body, are fabricated from plastics. They can easily break during assembly and when under stress, and so require improvement.

SUMMARY OF THE PRESENT DISCLOSURE

The technical problem addressed by the Present Disclosure lies in overcoming the abovementioned shortcomings of the existing technology. The Present Disclosure presents a cable connector that helps boost the reliability of the connection between the conductive terminals and circuit board, and it features fairly good electromagnetic compatibility.

The Present Disclosure presents a cable connector that addresses the abovementioned technical problems. It comprises a first connector and a cable connected to the end of the first connector; the first connector comprises a first connector body and a first circuit board. The first connector body comprises a first insulator body and a plurality of first conductive terminals installed on the first insulator body, and every first conductive terminal comprises a mating portion and a soldering portion. The first circuit board has a first surface and a second surface opposite each other, wherein a plurality of first connection points are installed on the first surface, and the soldering portions of the first conductive terminals are correspondingly soldered to the first connection points of the first circuit board. The first circuit board has a plurality of second connection points at the edge of the first surface and second surface, and the cable's plurality of conducting wires are correspondingly soldered to each of the second connection points. The first connector also comprises a first coating partially encasing the first circuit board; the first coating comprises a first portion and a second portion. The first portion encases one side of the first surface in order to encase the first connection points. The second portion encases the edge of the first surface and second surface in order to encase the second connection points.

The first connector body also comprises a first shielding shell installed along the outside of the first insulator body. A number of fixing legs extend out from the first shielding shell. The first circuit board has a number of fixing holes passing through the first surface and second surface. The fixing legs are correspondingly inserted into and secured to the fixing holes.

The first connector body is installed on the side with the first surface, and the tail portions of the fixing legs of the first shielding shell, protruding out of the second surface, are exposed on the outside of the first coating. The space between two neighboring first connection points is equal to the space between the soldering portions of two neighboring first conductive terminals. The space between two neighboring second connection points is greater than the space between two neighboring first connection points. The mating direction of the first connector body is perpendicular to the first surface of the first circuit board, the first portion and second portion of the first coating are joined together to form an angle of intersection, and the exit direction of the cable and the mating direction of the first connector body form an angle of intersection not equal to 90 degrees.

The first connector body also comprises a first shielding shell installed along the outside of the first insulator body. The first connector also comprises a first shielding shroud installed along the outside of the first circuit board and first coating. This first shielding shroud has an opening, and the first shielding shell passes out of this opening. The first shielding shroud and first shielding shell fit together to provide integral shielding for the first connector.

The first shielding shroud comprises a first metal shell and a second metal shell that lock together. The first metal shell comprises a top plate and side walls bending and extending out from the side edges of the top plate. The top plate has the previously described opening, and the side walls have at least one first locking portion. The second metal shell comprises a bottom plate and side walls bending and extending out from the side edges of the bottom plate. The side walls have at least one second locking portion, which snaps together with the first locking portion of the first metal shell.

The first shielding shroud also comprises a third metal shell, which closes to form a chamber through which the first shielding shell passes. The third metal shell extends out from the opening of the first metal shell. Its front end has at least one first folded piece bending and extending inward. Its back end has at least one second folded piece bending and extending outward, for joining along the outside of the first metal shell's opening.

The cable connector also comprises a second connector connected to the other end of the cable. The second connector comprises a second connector body, a second circuit board electrically connected between the second connector body and the cable, and a second shielding shroud. The first connector body is a connector plug and the second connector body is a connector socket. The first connection points are arranged on a plurality of solder pads on the first surface of the first circuit board. The first connector body is installed on the side with the first surface. The soldering portions of the first conductive terminals are correspondingly soldered to these solder pads using a surface mount technology.

Compared to the existing technology, the cable connector of the Present Disclosure has, inter alia, the following benefits: By installing a plurality of second connection points on the first surface and second surface, it is possible to increase the distance between neighboring second connection points while not increasing the width of the first circuit board, and thus it is suited to precision solder wire. By designing a first coating that partially encases the first circuit board, and by having the coating comprise a first portion and a second portion to encase the first connection points from the first surface and to encase the second connection points from the edge of the first and second surfaces, it can prevent external force from damaging the solder points. And when conducting overmolding for the first coating, the injected melted plastic will not jack the fixing legs or tail portions of the first conductive terminals away from the second surface of the first circuit board, which would impair the connection between the first conductive terminals and the first circuit board. Thus, it helps boost the product acceptance rate. By extending a number of fixing legs backward from the first shielding shell and soldering them to the first circuit board, and given the considerable strength of these metal fixing legs, it is possible to more effectively prevent external force from being exerted on and damaging the solder points between the conductive terminals of the first connector body and the first circuit board. By fitting the first shielding shroud together with the first shielding shell and providing integral shielding for the first connector, it is possible to reduce external electromagnetic radiation interference when the first connector is working and to reduce the electromagnetic radiation emitted during operation, which helps boost electromagnetic compatibility.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
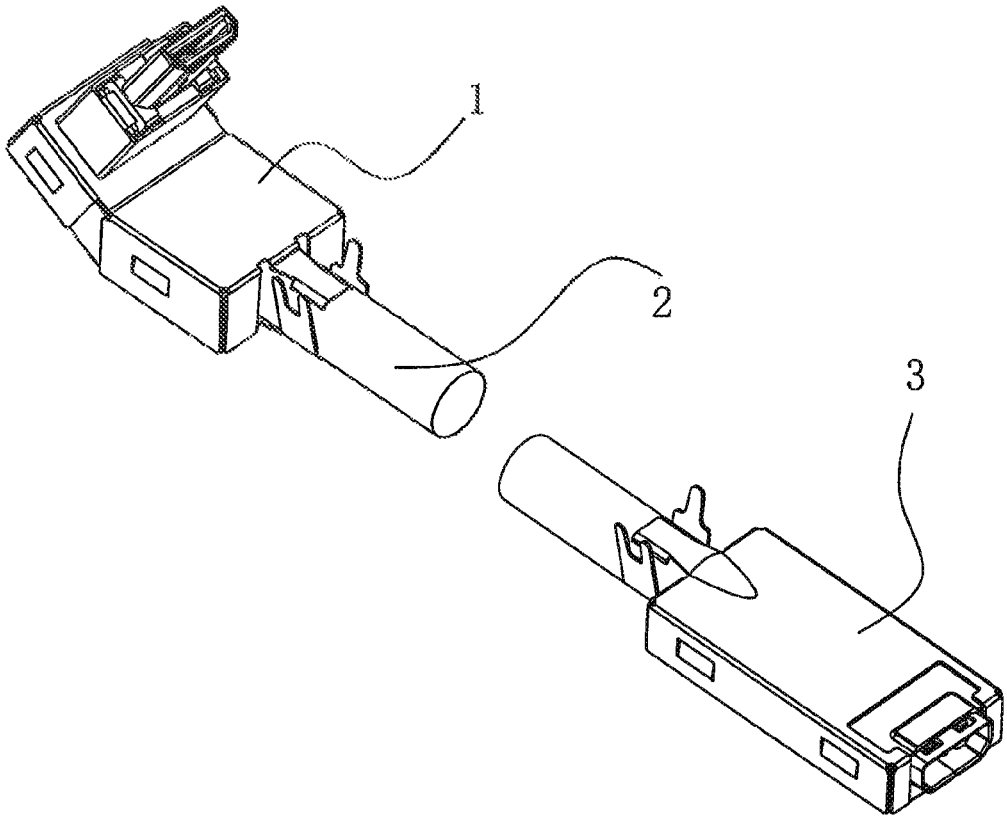
FIG. 1 is a perspective view of a preferred embodiment of the cable connector of the Present Disclosure.

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

A preferred embodiment of the cable connector of the Present Disclosure is shown in FIGS. 1-9. It comprises a first connector 1, a cable 2 connected to the end of the first connector 1, and a second connector 3 connected to the other end of the cable 2. The cable 2 comprises a plurality of conducting wires 21. In the Present Disclosure, the first connector 1 is a Micro-HDMI plug, and the second connector 3 is a Micro-HDMI socket.

The first connector 1 comprises a first connector body 11, a first circuit board 12 electrically connected between the first connector body 11 and cable 2, a first coating 13 partially encasing the first circuit board 12, and a first shielding shroud 14 installed along the outside of the first connector 1.

Figure 7:
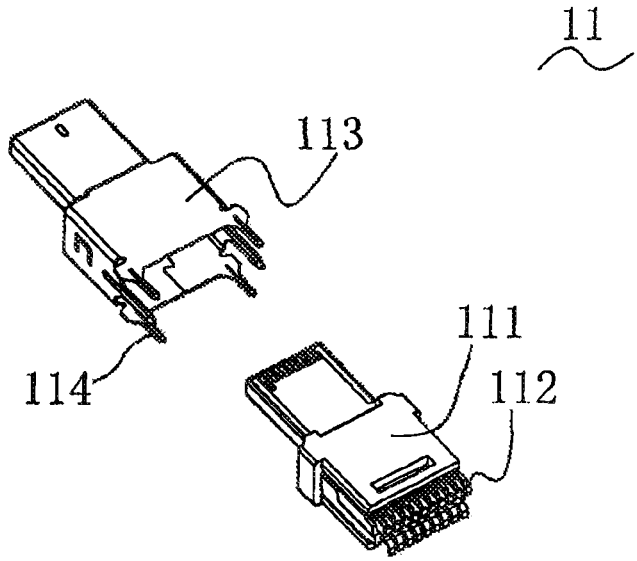
FIG. 7 is a perspective exploded view of the first connector body of a preferred embodiment of the cable connector of the Present Disclosure.
Figure 8:
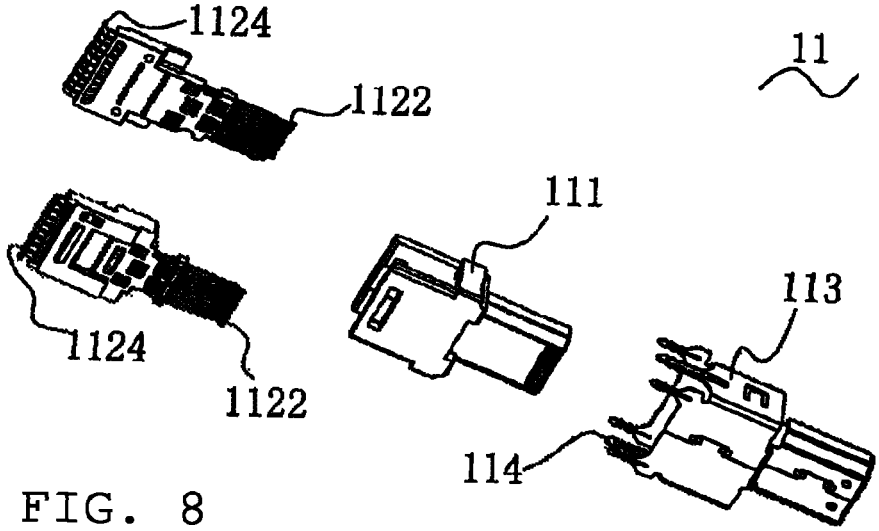
FIG. 8 is a further perspective exploded view of the first connector body of a preferred embodiment of the cable connector of the Present Disclosure.

See FIGS. 7 and 8. The first connector body 11 comprises a first insulator body 111, a number of first conductive terminals 112 installed on the first insulator body 111, and a first shielding shell 113 installed along the outside of the first insulator body 111. The first shielding shell 113 extends backward in six fixing legs 114. Each conductive terminal 112 comprises a mating portion 1122 and a soldering portion 1124.

Figure 5:
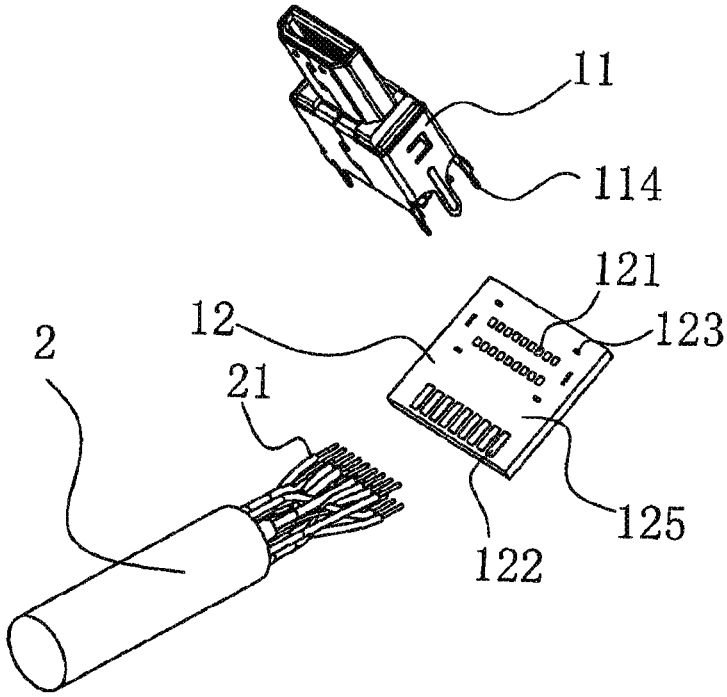
FIGS. 5 and 6 are perspective exploded views of the first connector body, first circuit board, and cable of a preferred embodiment of the cable connector of the Present Disclosure from two different perspectives.
Figure 6:
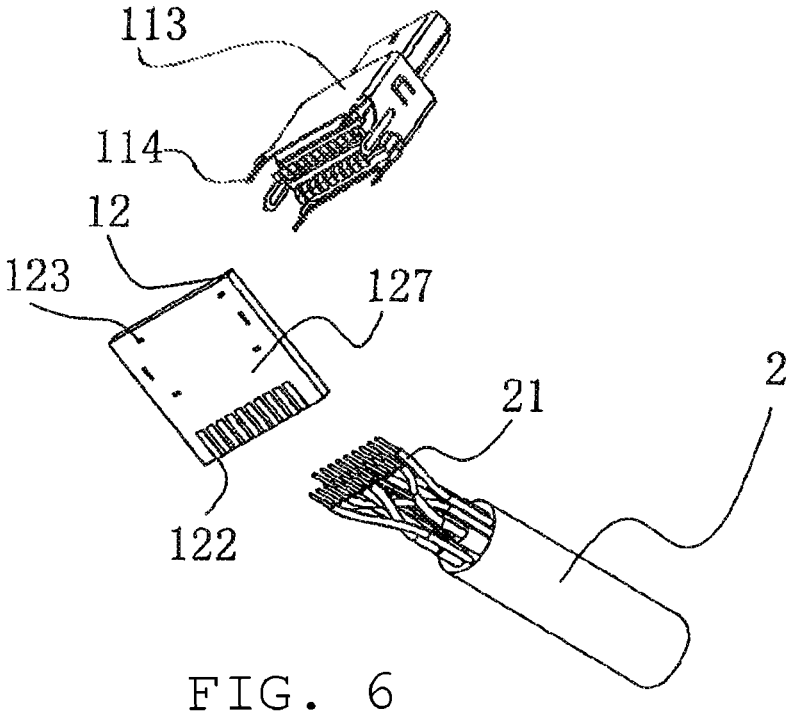

See FIGS. 5 and 6. The first circuit board 12 comprises a first surface 125 and a second surface 127 opposite each other, wherein a plurality of first connection points 121 are positioned in the middle of the first surface 125, and six fixing holes 123 pass through the first surface 125 and second surface 127. In the present preferred embodiment, these first connection points 121 are solder pads arranged in two rows, whereas in other embodiments, they can be solder holes. The first connector body 11 is perpendicularly installed and soldered to the side with the first surface 125 of the first circuit board 12; its mating direction is perpendicular to the first surface 125 of the first circuit board 12. Here, the soldering portions 1124 of the first conductive terminals 112 are correspondingly soldered to first connection points 121 using a surface mount technology, and the space between two neighboring first connection points 121 is equal to the space between the soldering portions 1124 of two neighboring first conductive terminals 112. The six fixing legs 114 on the first shielding shell 113 are correspondingly inserted and soldered into the six fixing holes 123. This more firmly attaches the first connector body 11 to the first circuit board 12, and prevents the solders between the soldering portions 1124 of the first conductive terminals 112 and the first connection points 121 of the first circuit board 12 from being damaged by external force.

The edge of the first surface 125 and second surface 127 of the first circuit board 12 has a plurality of second connection points 122, and the space between two neighboring second connection points 122 is greater than the space between two neighboring first connection points 121. The cable's 2 plurality of connecting wires 21 are correspondingly soldered to each second connection point 122. This arrangement helps increase the space between two neighboring second connection points 112, and this makes it easier to precisely solder the conducting wires 21 in the cable 2 to the second connection points 122 of the first circuit board 12.

Figure 2:
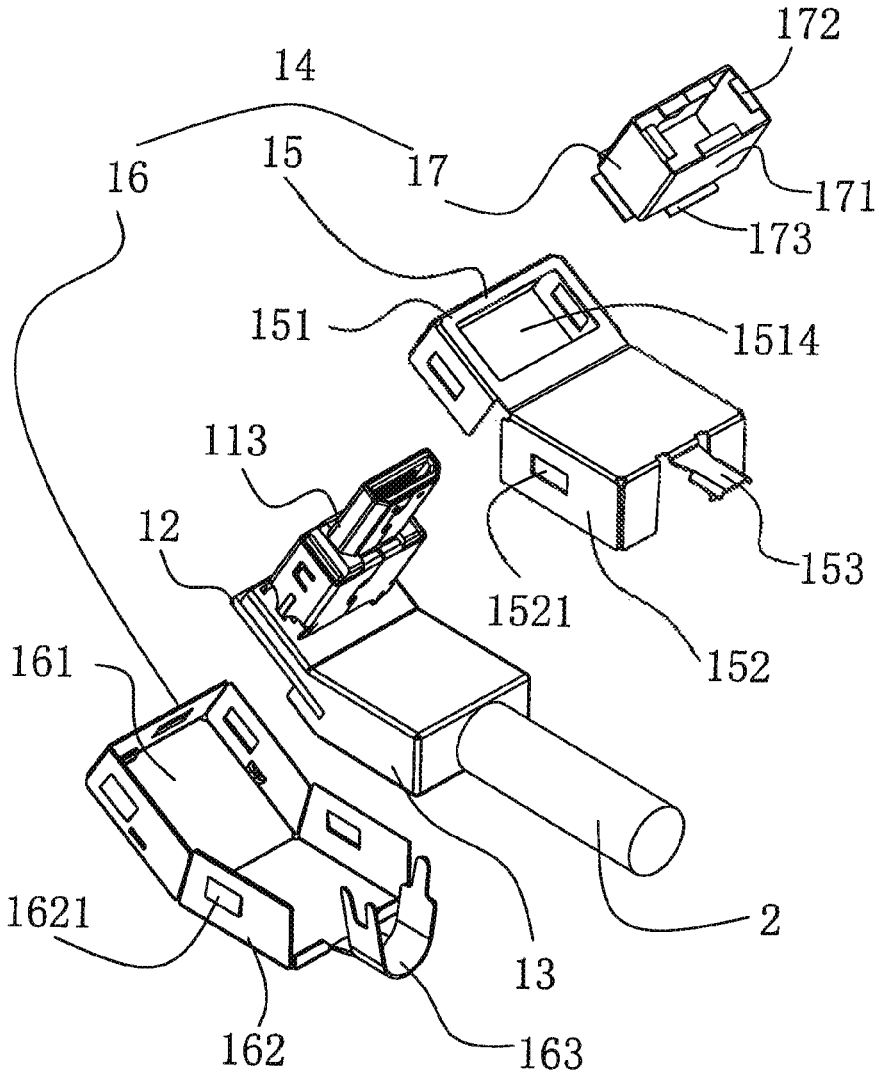
FIGS. 2 and 3 are perspective exploded views of the first connector and cable of a preferred embodiment of the cable connector of the Present Disclosure from two different perspectives.
Figure 3:
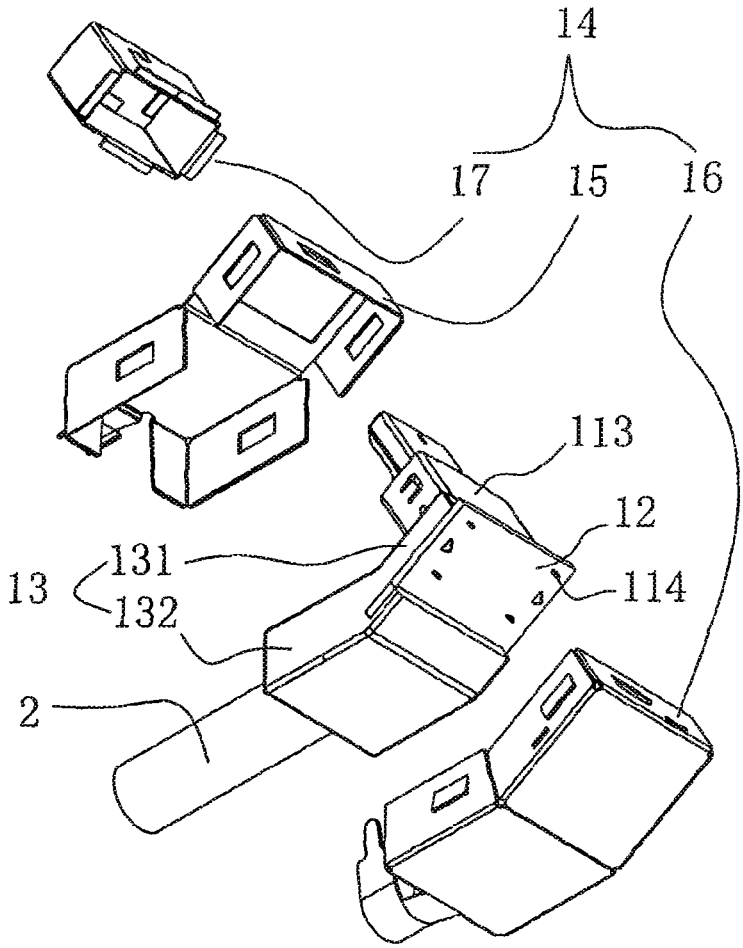
Figure 4:
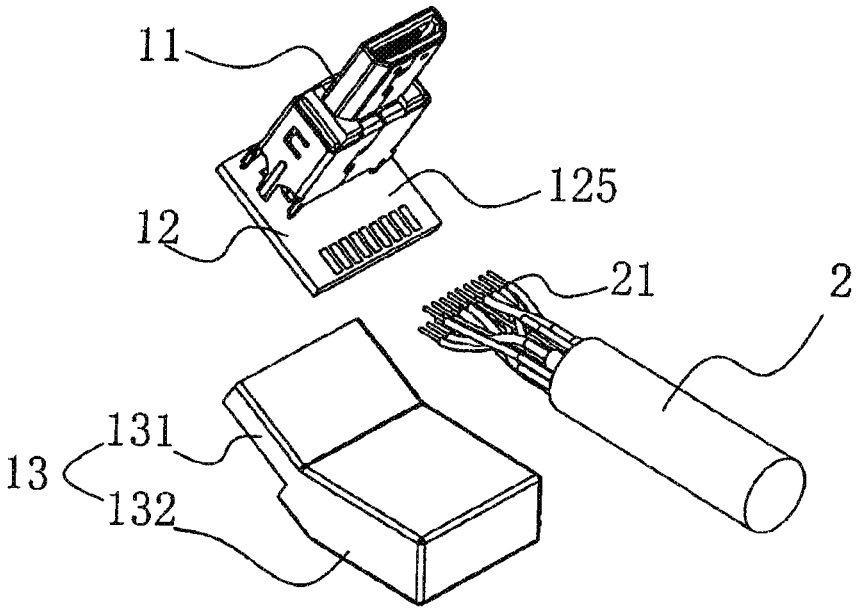
FIG. 4 is a perspective exploded view of the first connector body and first circuit board, first coating, and cable of a preferred embodiment of the cable connector of the Present Disclosure.

See FIGS. 2, 3 and 4. The first coating 13 partially encases the first circuit board 12, and it comprises a first portion 131 and a second portion 132 that are joined together to form an angle of intersection. The first portion 131 encases one side of the first surface 125 of the first circuit board 12 in order to encase the first connection points 121; the second portion 132 encases the edge of the first surface 125 and second surface 127 in order to encase the second connection points 122. The first coating 13 is injection formed as a whole using hot melt glue or melted plastic material; it surrounds the first connection points 121 and second connection points 122 and can play a role in preventing external force from damaging the solders. Here, the tail portions of the fixing legs 114 of the first shielding shell 113, protruding out of the second surface 127, are exposed on the outside of the first coating 13. This way, the plastic injected during the process of forming the first coating 13 will not jack the first connector body's 11 fixing legs 114 up from the second surface 127 of the first circuit board 12, which would impair the solder connection between the first conductive terminals 112 of the first connector body 11 and the first connection points 121 of the first circuit board 12.

The second portion 132 of the first coating 13 also encases a wire terminal connecting the cable 2 to the first circuit board 12, thus acting to secure the exit direction. Because the first portion 131 and second portion 1323 form an angle of intersection, the exit direction of the cable 2 and the mating direction of the first connector body 11 can form an acute angle, thus boosting the flexibility of the design.

See FIGS. 2 and 3. The first shielding shroud 14 surrounds the first circuit board 12 and the first coating 13, and it comprises at least one first metal shell 15 and one second metal shell 16 that lock together. The first metal shell 15 comprises a top plate 151 and a plurality of side walls 152 bending and extending out from the side edges of the top plate 151; the top plate 151 has an opening 1514 through which the first connector body 11 can pass, and the side walls 152 have at least one first locking portion 1521. The second metal shell 16 comprises a bottom plate 161 and a plurality of side walls 162 bending and extending out from the side edges of the bottom plate 161; the side walls 162 have at least one second locking portion 1621, which snaps together with the first locking portion 1521 of the first metal shell 15. The first shielding shroud 14 fits together with the first shielding shell 113 extending out from the opening 1514 in the first shielding shroud 14, and can achieve an initial integral electromagnetic shielding effect for the first connector 1. The back ends of the top plate 151 and bottom plate 161 extend a first tail portion 153 and second tail portion 163 out toward each other; the first tail portion 153 and second tail portion 163 fit together and can be used to sandwich the wire terminal of the cable 2.

The first shielding shroud 14 can also further comprise a third metal shell 17 extending out from the opening 1514 of the first metal shell 15. This third metal shell 17 comprises a body 171, at least one first folded piece 172 bending and extending inward from the front end of the body 171, and at least one second folded piece 173 bending and extending outward from the back end of the body 171. The body 171 is enclosed by four side walls to provide a chamber through which the first connector body 11 may pass. Here, the first folded piece 172 is used to seal off any gaps in the first insulator body 111 that have not yet been completely shielded by the first shielding shell 113, and the second folded piece 173 is used for joining along the outside of the opening 1514 of the first metal shell 15. Through an optimized block design, the first shielding shroud 14 features relatively easy processing and manufacturing, and it can achieve integral shielding results for this type of zigzag first connector 1. It should be noted that the third metal shell 17 can be deleted. The addition of a third metal shell 17 simply makes it possible to further strengthen the shielding results of the shielding shroud 14 and boost the electromagnetic compatibility of the first connector 1.

Figure 9:
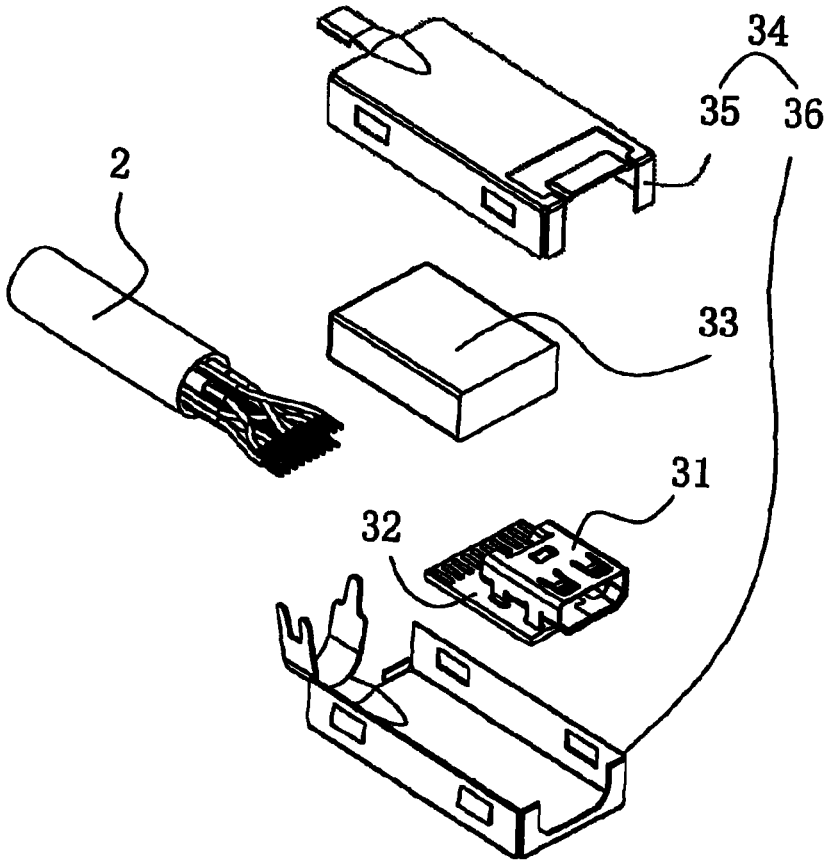
FIG. 9 is a perspective exploded view of the second connector and cable of a preferred embodiment of the cable connector of the Present Disclosure.

See FIG. 9. The second connector 3 comprises a second connector body 31, a second circuit board 32 electrically connected between the second connector body 31 and the cable 2, a second coating 33, and a second shielding shroud 34. The second connector body 31 is horizontally fitted onto the upper surface of the second circuit board 32, and its mating direction is parallel to the upper surface of the second circuit board 32. The second shielding shroud 34 is formed by locking two metal shells 35 and 36 together, and it surrounds the second connector body 31, the second circuit board 32, and the wire terminal of the cable 2.

The main assembly process for the first connector 1 of the Present Disclosure's cable connector roughly includes the following steps: First, solder the first connector body 11 to the first circuit board 12. Then solder one end of the cable 2 to the circuit board 12. Next, place the soldered first connector body 11, first circuit board 12, and cable 2 in an injection mold (not shown) and inject melted plastic around the first circuit board 12 for integral injection forming of the first coating 13. Finally, install the first shielding shroud 14 around the first connector 1. This specifically comprises: fixing the second metal shell 16 to the first circuit board 12 and bottom portion of the first coating 13, then installing the third metal shell 17 around the first connector body 11, and finally snapping the top of the first metal shell 15 to the first circuit board 12 and top portion of the first coating 13. This causes the third metal shell 17 to be inserted and contained within the opening 1514 on the top plate 151. After exerting pressure, it is possible to snap the first metal shell 15 and second metal shell 15 together and complete assembly.

While a preferred embodiment of the Present Disclosure is shown and described, it is envisioned that those skilled in the art may devise various modifications without departing from the spirit and scope of the foregoing Description and the appended Claims.

What is claimed is:

1. A cable connector comprising:

a first connector, the first connector including:

a first connector body, the first connector body including a first insulator body and a plurality of first conductive terminals installed on the first insulator body, each first conductive terminal including a mating portion and a soldering portion; and a first circuit board, the first circuit board including a first surface and a second surface opposite each other, a plurality of first connection points installed on the first surface, soldering portions of each first conductive terminal is correspondingly soldered to the first connection points of the first circuit board; and a cable connected to the end of the first connector;

wherein:

the first circuit board includes a plurality of second connection points at the edge of the first surface and second surface, a plurality of conducting wires of the cable are correspondingly soldered to each second connection point; and the first connector includes a first coating partially encasing the first circuit board, the first coating including a first portion and a second portion, the first portion encases one side of the first surface in order to encase the first connection points, and the second portion encases the edge of the first surface and second surface in order to encase the second connection points.

2. The cable connector of claim 1, wherein the first connector body further includes a first shielding shell installed along the outside of the first insulator body.

3. The cable connector of claim 2, wherein a number of fixing legs extend out from the first shielding shell.

4. The cable connector of claim 3, wherein the first circuit board further includes a number of fixing holes passing through the first surface and second surface.

5. The cable connector of claim 4, wherein the fixing legs are correspondingly inserted into and secured to the fixing holes.

6. The cable connector of claim 5, wherein the first connector body is installed on the side with the first surface, and the tail portions of the fixing legs of the first shielding shell, protruding out of the second surface, are exposed on the outside of the first coating.

7. The cable connector of claim 1, wherein the space between two neighboring first connection points is equal to the space between the soldering portions of two neighboring first conductive terminals.

8. The cable connector of claim 7, wherein the space between two neighboring second connection points is greater than the space between two neighboring first connection points.

9. The cable connector of claim 1, wherein the mating direction of the first connector body is perpendicular to the first surface of the first circuit board, the first portion and second portion of the first coating are joined together to form an angle of intersection, the second portion of the first coating also encases a wire terminal connecting the cable to the first circuit board, and the exit direction of the cable and the mating direction of the first connector body form an angle of intersection not equal to 90 degrees.

10. The cable connector of claim 2, wherein the first connector further includes a first shielding shroud installed along the outside of the first circuit board and first coating.

11. The cable connector of claim 10, wherein the first shielding shroud includes an opening, and the first shielding shell passes out of this opening.

12. The cable connector of claim 11, wherein the first shielding shroud and first shielding shell fit together to provide integral shielding for the first connector.

13. The cable connector of claim 12, wherein the first shielding shroud comprises a first metal shell and a second metal shell that lock together.

14. The cable connector of claim 13, wherein the first metal shell further includes a top plate and side walls bending and extending out from the side edges of the top plate.

15. The cable connector of claim 14, wherein the top plate has the previously described opening, and the side walls have at least one first locking portion.

16. The cable connector of claim 15, wherein the second metal shell includes a bottom plate and side walls bending and extending out from the side edges of the bottom plate.

17. The cable connector of claim 16, wherein the side walls have at least one second locking portion, which snaps together with the first locking portion of the first metal shell.

18. The cable connector of claim 17, wherein:

the first shielding shroud further includes a third metal shell, which closes to form a chamber through which the first shielding shell passes; and the third metal shell extends out from the opening of the first metal shell, its front end has at least one first folded piece bending and extending inward, and its back end has at least one second folded piece bending and extending outward, for joining along the outside of the first metal shell's opening.

19. The cable connector of claim 1, wherein the cable connector further includes a second connector connected to the other end of the cable;

the second connector includes a second connector body, a second circuit board electrically connected between the second connector body and the cable, and a second shielding shroud; and the first connector body is a connector plug and the second connector body is a connector socket.

20. The cable connector of claim 1, wherein the first connection points are arranged on a plurality of solder pads on the first surface of the first circuit board;

the first connector body is installed on the side with the first surface; and the soldering portions of the first conductive terminals are correspondingly soldered to these solder pads using a surface mount technology.

* * * * *